United States Patent [19]

Eidelman

[11] Patent Number: 4,823,672

[45] Date of Patent: Apr. 25, 1989

[54] APPARATUS AND METHOD FOR NEUTRALIZING MINE FIELDS

[75] Inventor: Shmuel Eidelman, Rockville, Md.

[73] Assignee: Science Applications International Corporation, La Jolla, Calif.

[21] Appl. No.: 88,273

[22] Filed: Aug. 24, 1987

[51] Int. Cl.[4] ..... E41H 11/12; E41F 1/00; E42D 3/00

[52] U.S. Cl. ..... 89/1.13; 89/1.34; 102/403

[58] Field of Search ..... 89/1.13, 1.11, 1.1, 89/1.34; 102/403

[56] References Cited

U.S. PATENT DOCUMENTS

| | | | |
|---|---|---|---|
| 2,409,848 | 10/1946 | Greulich | 89/1.13 |
| 2,455,354 | 12/1948 | Bisch | 102/403 |
| 3,183,835 | 5/1965 | Bisch | 89/1.13 |
| 3,242,862 | 3/1966 | Stegbeck et al. | 89/1.13 |
| 3,638,569 | 2/1972 | Thomenek | 89/1.13 |
| 3,724,319 | 4/1973 | Zabelka et al. | 89/1.13 |
| 4,294,157 | 10/1981 | Staucil | 89/1.34 |
| 4,671,162 | 6/1987 | Adlam et al. | 89/1.13 |

*Primary Examiner*—David H. Brown

*Attorney, Agent, or Firm*—Burns, Doane, Swecker & Mathis

[57] ABSTRACT

An apparatus for neutralizing mines includes several strands of explosive charge which are adapted to be rolled up into a cable. The cable containing the strands of explosive charge can be launched across a mine field by a rocket. The cable is opened and the strands of explosive are deployed to form a two-dimensional array disposed a certain distance above the ground. The strands of charge are separated by a fixed distance which is less than or equal to the distance of the strands of charge above the ground. Upon detonation of the explosive a substantially uniform blast wave is created exerting uniform pressure and impulse on the mine field below. The detonation should occur substantially simultaneously so that the blast from adjacent charges will interact thereby creating a planar wavefront.

9 Claims, 4 Drawing Sheets

SECTION A-A

SECTION B-B

APPARATUS AND METHOD FOR NEUTRALIZING MINE FIELDS

BACKGROUND OF THE INVENTION

1. Field of the Invention

This invention relates to a device for neutralizing mine fields and more particularly to an array of explosives which are positioned such that upon detonation of the explosives a planar wave is set up, exerting substantially uniform pressure upon the ground and thereby maximizing the area of mine clearing effectiveness from a given amount of charge.

2. Background Description

It has been heretofore conventional when attempting to neutralize mine fields to provide an apparatus with charges distributed in an array blanketing the area to be cleared.

Examples of the aforesaid apparatuses are shown by U.S. Pat. Nos. 2,455,354 and 3,242,862. These patents disclose devices having charges distributed over an area to be cleared of mines. Upon detonation the blast produced by the individual charges is concentrated in the area adjacent the charges and diminishes further away from the individual charges. Therefore, if a mine was located in an area between charges there is a less likely chance of it being neutralized than if the mine was located directly beneath a charge, where the blast from the charge is greatest. The overpressure from the blast is not uniform over the area to be cleared of mines. To ensure reliability of these devices in clearing mines located between charges it would be necessary to increase the size of the individual charges or to space the charges close together.

U.S. Pat. No. 3,724,319 discloses a device for clearing mine fields which uses fuel-air explosives. This device includes a series of fuel containers which are deposited along a mine field. The containers are then explosively ruptured forming an elongated fuel-air cloud contiguous to the mine field. Shortly thereafter, the cloud is detonated by a high explosive wave, producing overpressure on the mine field which detonates mines sensitive to such overpressure. Although the fuel-air explosive provides a more uniform coverage of the mine field than the distributed charges described above, there are many problems associated with its use. It is difficult to distribute the liquid fuel homogeneously in air. Therefore, part of the cloud may not detonate due to lack of proper fuel concentration. The strength of the detonation wave in the fuel-air explosive is limited by the amount of oxygen in the air. The amount of overpressure exerted on a mine field is limited to about 20 atmospheres for liquid hydrocarbons, which are commonly used as the fuel in fuel-air explosives. Windy or rainy weather make the explosive yield of fuel-air explosives uncertain.

The foregoing illustrates limitations known to exist in present devices. Thus, it is apparent that it would be advantageous to provide an alternative directed to overcoming one or more of the limitations set forth above.

Therefore it is a general object of the present invention to provide an apparatus for neutralizing mine fields having explosive charges which are distributed such that, upon detonation, a planar wavefront is set up thereby exerting a substantially uniform impulse and pressure on the ground within the area to be neutralized.

It is another object of the invention to provide an apparatus for neutralizing mine fields which is efficient, whereby a minimum amount of explosive charge is utilized in neutralizing a given area in a mine field.

It is another object of the invention to provide an apparatus for neutralizing mine fields which can obtain a maximum blast, with a large impulse and overpressure, from a given amount of explosive.

SUMMARY OF THE INVENTION

In one aspect of the present invention, this is accomplished by providing an apparatus for neutralizing mine fields which includes a plurality of strands of explosive charge adapted to be rolled up into a roll. It also includes a means for deploying strands of explosive charge in an array so that upon detonation of the strands of explosive charge a planar wavefront blast will be created exerting a substantially uniform impulse and overpressure on the mine field and means for detonating the plurality of strands of explosive charge wherein said detonation occurs substantially simultaneously.

The foregoing and other aspects will become apparent from the following detailed description of the invention when considered in conjunction with the accompanying drawings. It is to be expressly understood, however, that the drawings are not intended as a definition of the invention but are for the purpose of illustration only.

DESCRIPTION OF THE PREFERRED EMBODIMENT

Figure 1:
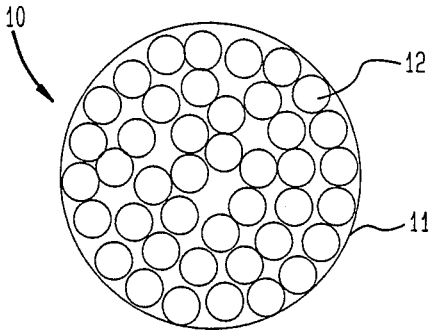
FIG. 1 is an end view of one embodiment of the mine neutralizing apparatus prior to deployment.
Figure 2:
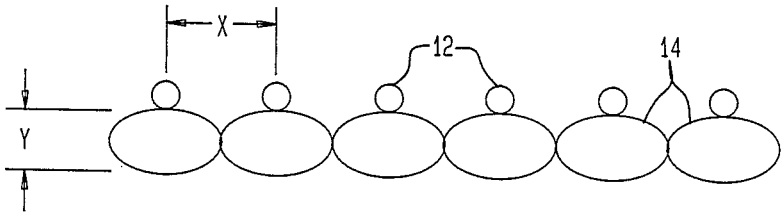
FIG. 2 is an end view of the embodiment of the mine neutralizing device shown in FIG. 1 subsequent to deployment.
Figure 3:
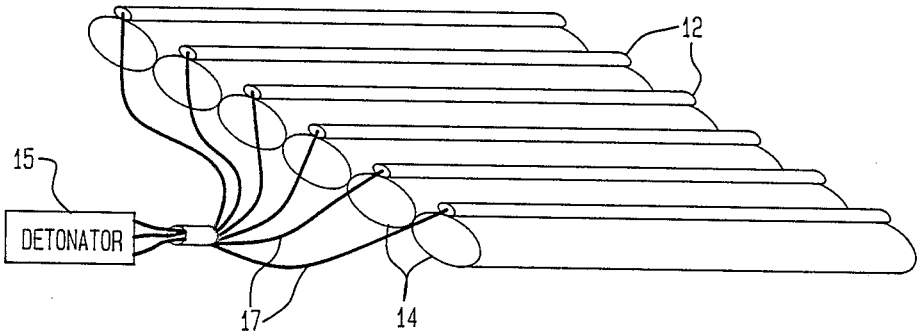
FIG. 3 is a perspective view of the embodiment of the mine neutralizing device shown in FIGS. 1 and 2.

One object of the present invention is to obtain a maximum blast effect from a given weight of explosive charge. An apparatus for achieving this goal is shown in FIGS. 1–3. FIG. 1 is an end view of the mine neutralizing apparatus which includes a roll 10. The apparatus contains several strands of explosive charge 12 contained inside a casing 11. In the preferred embodiment, the strands of explosive charge are commercially available Primacord. The Primacord strands contain the explosive material PETN. The strands 12 in the preferred embodiment are shown as having an eliptical cross section. However, the strands 12 may have other cross sectional shapes including, but not limited to, circular and flat-rectangular cross-sections. The casing 11, in the preferred embodiment is made of a plastic material. However, other suitable substances may be used.

Figure 5:
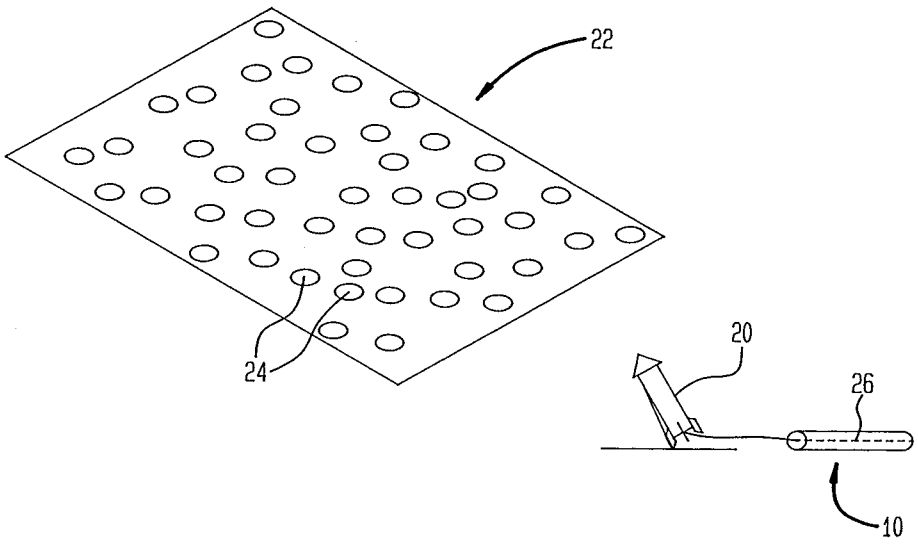
FIG. 5 is a perspective view of a means for launching the mine neutralizing device.

The mine neutralizing device of FIG. 1 is shown prior to deployment. The roll 10 containing the Primacord strands 12 are deployed by launching a rocket 20 across a mine field 22 as shown in FIG. 5. The rocket 20 is connected to pull the roll 10 behind it. Once the roll has been dragged the length of the mine field, it is opened. The opening of the roll 10 can be caused by the impact created on the plastic casing 11 when the cable 10 lands on the ground. To facilitate the breaking of the plastic casing 11, a perforation 26 may be provided as shown in FIG. 5. The perforation 26 runs the entire length of the casing 11. When the roll hits the ground, the perforation 26 will break open. Typical dimensions for the roll 10, are 100 meters long by 4 meters wide when fully deployed. This will allow tanks and trucks to cross through the neutralized area. If the mine field exceeds 100 meters, additional rolls 10 can be deployed.

Compressed gas is used to inflate tubular sections 14 as shown in FIGS. 2 and 3. The compressed gas will also help open the casing 11 and cause the strands to spread out in their deployed position. The compressed gas may be contained in small bottles connected to each section of tubular strip or one source of compressed gas can supply all tubular sections 14. The tubular sections 14 are attached to the underside of the Primacord strands so that upon inflation, the Primacord strands are elevated a distance y above the mine field. At the same time, the Primacord strands are separated by a distance x.

The Primacord strands 12 are then detonated substantially simultaneously, thereby neutralizing the mines contained in an area below and between the Primacord strands 12. A detonator 15 for detonating the Primacord strands 12 is shown in FIG. 3. The detonator 15 is connected to the individual strands 12 via short strands 17 of Primacord or other suitable material. Each of these short strands 17 is of approximately equal length so that a substantially simultaneous detonation of all of the charges 12 will occur.

To achieve a planar blast wave the distance x between adjacent strands 12 should be less than or equal to the distance y of the strands 12 above the mine field. Because of this relation between distances x and y, the initial blast wave which strikes the ground upon detonation will have a substantially planar wavefront across the area of the linear array of charges. This is because, upon detonation, the blasts from the individual strands will move downwards toward the mine field and outwards towards adjacent strands 12 at approximately the same rate of speed. The blast waves projected outwards will collide with adjacent blast waves before the blast waves projected downward have reached the mine field. Due to the interaction of adjacent blast waves a substantially planar wavefront is created before the initial impact of the blast upon the minefield. The planar blast load creates strong incident waves on the mine field. The strong impulse and overpressure generated by the blast is sufficient to neutralize all mines, even those which are not pressure sensitive, but are only sensitive to a particular noise, such as the noise of a tank or truck.

Devices as described above are capable of providing a 5:1 advantage over the present devices in the amount of charge needed to effectively neutralize a given area of a mine field. Because of the reduction in the payload needed for a given area, the weight of the individual rolls 10 is substantially reduced. This will make it much easier to deploy the rolls 10 over the mine fields.

The present apparatus can be designed to also take advantage of the available oxygen in the surrounding air. In general, the energy released in an explosive process represents only a part of the total chemical energy in the explosive. For example, the energy released by the combustion of RDX is twice as great at the explosive energy released by detonating solid RDX. The solid explosive detonation products usually contain CO, H2, C, and other combustible materials. In the present system, a large fraction of the combustibles will react with the oxygen in the air because the charges are distributed over a larger volume. Because of the additional energy release, the explosive effect will be greater than the detonation of the same mass of explosive concentrated in a single solid body. Other advantages of this system are that the overpressure and impulse generated can be varied over a wide range by varying the size of the explosive charges and the distance between them, and they are not sensitive to weather conditions. The present system can also be designed to provide blast waves with enhanced effects in a preferred direction.

Figure 4:
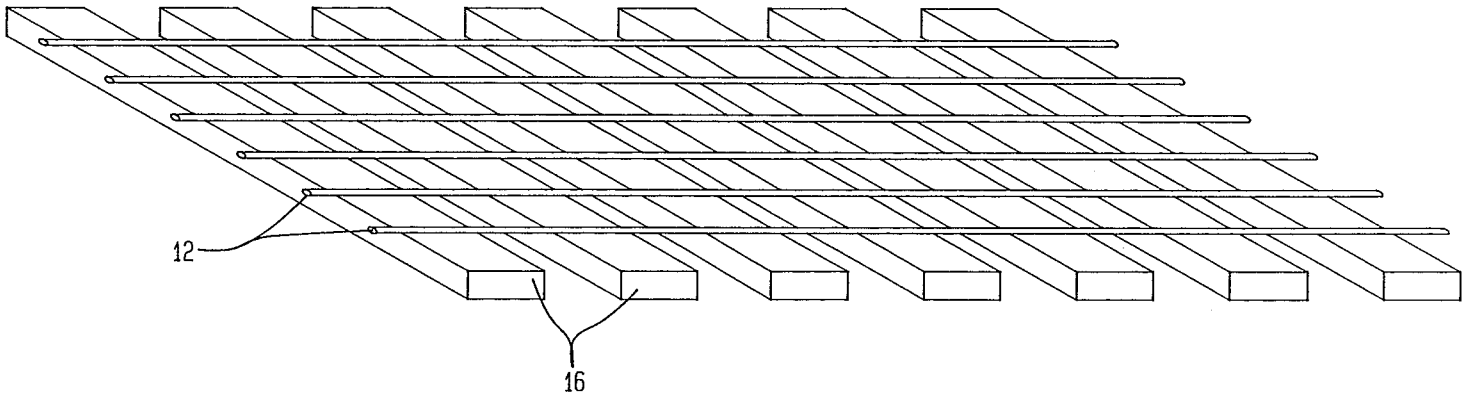
FIG. 4 is an alternate embodiment of a mine neutralizing device shown subsequent to deployment.

An alternate embodiment of the mine clearing apparatus is shown in FIG. 4. In this embodiment, there is no need to provide inflatable sections 14. Instead, the Primacord strands 12 are elevated and separated by sections of foam-sponge 16 which are connected to the bottom of the strands 12 and run perpendicular thereto. Prior to deployment of the roll 10, the elements 16 are compressed. Upon deployment the foam-sponge sections 16 expand to maintain the proper distance of the Primacord strands 12 above the mine field and the distance between the Primacord strands. Element 16 is described as a foam-sponge material in this embodiment, however any suitable substitute may also be used.

Figure 6B:
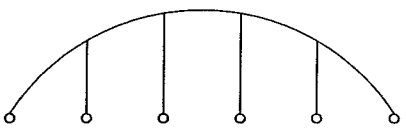
FIG. 6 includes a perspective view, FIG. 6*a*, and sectional views, FIGS. 6*b* and 6*c*, of an alternate embodiment of a mine neutralizing device.
Figure 6C:
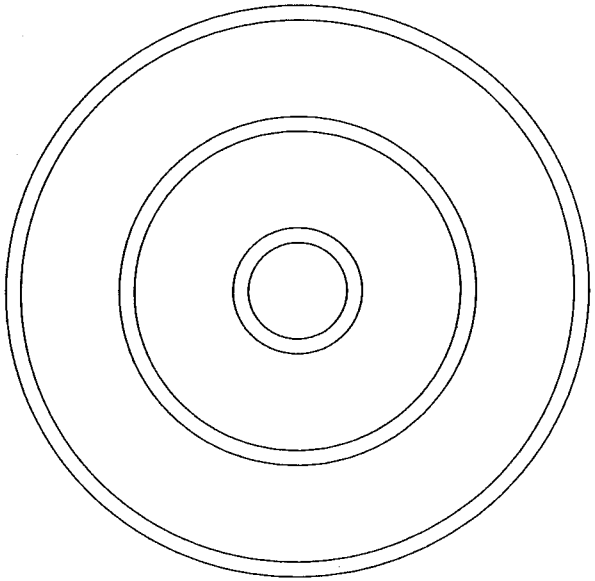
Figure 6A:
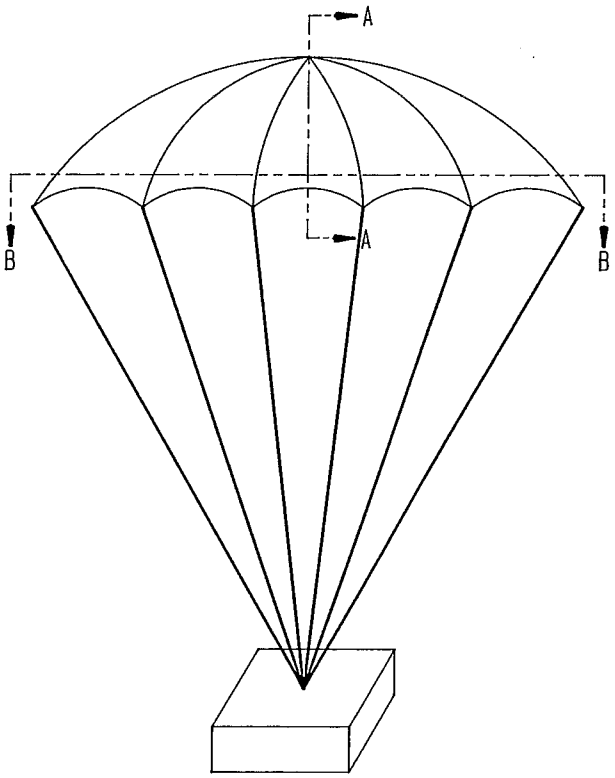

Other suitable arrangements for providing a planar blast wave in accordance with the present invention can also be employed. For example, the linear charges can be carried by a parachute, or even incorporated within the structure of the parachute itself as shown in FIG. 6, and detonated when the parachute is at a height above the ground which satifies the relationship necessary to achieve a planar blast wave. Furthermore, it is not necessary to use linear charges, i.e., a two-dimensional array of discrete point charges could also be employed.

It will be appreciated by those of ordinary skill in the art that the present invention can be embodied in other specific forms without departing from the spirit or essential characteristics thereof. The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. A method of neutralizing mines in a mine field, comprising the steps of:

deploying a plurality of explosive charges over a mine field in an array and in spaced relation to the ground and one another so as to create on detonation a substantially planar wavefront blast; and substantially simultaneously detonating the explosive charges, the initial impact on the ground comprising said substantially planar wavefront blast which creates a substantially uniform impulse and overpressure on the mine field whereby mines contained in said mine field are neutralized, wherein during said step of deploying said explosive charges are spaced above said mine field by a first distance and said plurality of explosive charges are separated from one another by a second distance wherein said second distance is less than or equal to said first distance.

2. A method of neutralizing a mine field as claimed in claim 1 wherein during said step of deploying said explosive charges are spaced above said mine field by a first distance and said explosive charges are separated from one another by a second distance wherein said second distance is less than or equal to said first distance, and wherein said explosive charges are linear charges.

3. A method of neutralizing a mine field as claimed in claim 1, wherein during said step of deploying said explosive charges are spaced above said mine field by a first distance, said explosive charges comprising a plurality of strips, and adjacent ones of said plurality of strips of said explosive charges are separated by a second distance wherein said second distance is less than or equal to said first distance.

4. The method of claim 3 wherein said plurality of strips of explosive charges are deployed above said mine field substantially parallel to one another.

5. A method of neutralizing a mine field from mines, comprising the steps of:

deploying a plurality of strands of explosive charge over a mine field in an array, wherein said deploying step includes:

launching a cable containing said strands of explosive charge over said mine field;

inflating a plurality of plastic sections each attached to said plurality of strands of explosive charge so that said strands of explosive charge are elevated above the mine field by a first distance and separated from each other by a second distance, said second distance being less than or equal to said first distance; and creating a substantially simultaneous detonation of said plurality of strands of explosive charge so that a substantially planar wavefront blast is set up, exerting a substantially uniform impulse and overpressure on said mine field whereby mines contained therein are neutralized.

6. An apparatus for neutralizing mine fields, comprising:

a plurality of strands of explosive charge adapted to be rolled up in a cable;

means for deploying said strands of explosive charge in an array in spaced relation to the ground and one another so that upon detonation of the strands of explosive charge a substantially planar wavefront blast will be created exerting a substantially uniform impulse and overpressure on said mine field; and means for detonating said plurality of strands of explosive charge wherein said detonation occurs substantially simultaneously, wherein said means for deploying said strands of explosive charge includes means for elevating said strands above the mine field by a first distance and means for separating said strands from each other by a second distance so that said second distance is less than or equal to said first distance.

7. An apparatus for neutralizing mine fields as recited in claim 6, wherein said elevating and separating means includes a plurality of inflatable tubular sections corresponding to each one of said plurality of strands of explosive charge wherein said tubular sections are connected to said strands of explosive charge.

8. An apparatus for neutralizing mines as recited in claim 6, wherein said elevating and separating means includes a plurality of sections of a compressible material wherein said sections of compressible material lie substantially perpendicular to said strands of explosive and are connected to the bottom of said strands of explosive.

9. An apparatus for neutralizing mine fields as recited in claim 6, in which said means for deploying further comprises:

means for launching said cable containing said strands of explosive over a mine field.

* * * * *